United States Patent [19]

Blaak

[11] Patent Number: 4,599,208

[45] Date of Patent: Jul. 8, 1986

[54] FOAM GENERATOR

[75] Inventor: Cornelis Blaak, Boxmeer, Netherlands

[73] Assignee: Stork Brabant, An Boxmeer, Netherlands

[21] Appl. No.: 634,629

[22] Filed: Jul. 26, 1984

[30] Foreign Application Priority Data

Jul. 27, 1983 [NL] Netherlands ..... 8302678

[51] Int. Cl.[4] ..... B01F 3/04

[52] U.S. Cl. ..... 261/83; 261/18 R; 261/DIG. 26; 366/302; 521/917

[58] Field of Search ..... 261/83, 90, 18 R, 84, 261/DIG. 26, DIG. 16; 521/917; 366/302–304, 307; 422/135, 225

[56] References Cited

U.S. PATENT DOCUMENTS

| | | | |
|---|---|---|---|
| 1,927,376 | 9/1933 | Schroder et al. | 261/DIG. 26 |
| 2,581,918 | 1/1952 | Spencer | 261/DIG. 26 |
| 2,584,805 | 2/1952 | Leftwich | 261/90 X |
| 3,377,139 | 4/1968 | MacGregor et al. | 261/DIG. 26 |
| 3,881,871 | 5/1975 | Porter | 521/917 X |
| 4,042,217 | 8/1977 | Snider et al. | 261/DIG. 26 |

FOREIGN PATENT DOCUMENTS

| | | | |
|---|---|---|---|
| 306550 | 1/1930 | United Kingdom | 261/DIG. 26 |

*Primary Examiner*—Richard L. Chiesa

*Attorney, Agent, or Firm*—Pollock, Vande Sande & Priddy

[57] ABSTRACT

A foam generator conventionally consisting of a hollow stator (1) with a coaxial internal rotor (2) together forming an annular mixing chamber. Both stator and rotor are being provided with alternative rings of polygonal pins (4, 3) reaching within the mixing chamber, each pin having at least two ribs 11 creating a vortex trail during generation. The rate of occupancy of the pins (4, 3) is such that within a cross-sectional range for the mixing chamber between 40–90 $cm^2$, the quotient:

$$\frac{\text{total vortex line length}}{\text{volume of mixing chamber}}$$

amounts at least to 1.5 and is preferably between 2.4 and 3.0.

6 Claims, 2 Drawing Figures

FOAM GENERATOR

FIELD OF THE INVENTION

The present invention relates to a foam generator for producing a liquid-gas emulsion.

BACKGROUND OF THE INVENTION

Several types of generators are known in the art for producing foam from a liquid and a gas, for example a printing paste and air. Most of them consist of a cylindrical stator member having coaxially disposed therein a driven rotor member. The stator inner side and the rotor outer side are provided with rings of radial pins usually having a rectangular cross section. Viewed in axial direction, the stator and rotor rings are alternately disposed. The number of pins in each stator and rotor ring is identical.

In these foam generators, the processing capacity is small in relation to the size of the apparatus. For the preparation of a fine foam of about 200 grams per liter (specific weight approx. 0.2), it has been found in respect of a usual printing paste, that in the known foam generators the ratio (F) of the maximum quantity of paste to be processed, expressed in liters/min., with respect to the generator volume, likewise expressed in liters, has a value of approximately 2.5.

Relative to screen printing techniques, these factors imply that if a printing installation is to process, for example, a maximum of 11 liters/min. of printing paste, each printing unit requires a larger or several smaller types of foam generators to be installed, having a total capacity of 11/2.5=4.4 liters. Regardless of the costs incurred, the relatively large volume of the foam generator has the drawback of resulting in a loss of time before the actual printing procedure can start. This is due to the relatively long passage time of the printing paste, said time increasing to the extent that capacity smaller than the minimum capacity is to be processed. In addition, a considerable loss of printing paste occurs after printing, when the foam generator and the supply and discharge lines thereof are to be cleaned for the next printing operation, said cleaning operation requiring relatively much time.

OBJECT OF THE INVENTION

The present invention starts from a foam generator to be considered known per se and designed for producing a liquid/gas emulsion having a specific weight of at least 0.1, said generator comprising a hollow cylindrical stator and a cylindrical rotor coaxially rotatably driven therein, jointly forming a mixing chamber wherein stator and rotor rings of pins having a constant polygonal cross section are disposed alternately in the direction of the longitudinal axis, said mixing chamber furthermore being provided at one end with an inlet for the liquid and for the gas, an outlet opening for the emulsion prepared being provided at the other end. It is a significant object of the invention to improve said known foam generator in such a manner that the processing capacity thereof increases substantially, thus greatly reducing the aforesaid drawbacks.

No quantitative design rules are known to exist for dimensioning an optimum foam generator in terms of processing capacity and dimensions. The principle underlying the invention is derived from the concept that the most important factor for increasing the efficiency of a foam generator could reside in increasing the number of vortices being formed in the liquid/air mixture by the rotating pins. Starting from this concept it should be possible to increase the capacity of existing foam generators by raising the internal rate of occupancy (number of pins per volume unit of the mixing chamber). This affords introducting the concept of "vortex line density coefficient" (VLDC) consisting in the quotient:

$$\frac{\text{total vortex-line length (in cm)}}{\text{volume of mixing chamber (in cm}^3\text{)}}.$$

The total vortex-line length is then formed by the sum of the length of those ribs of all rotor pins from which a vortex trail is being shed during rotation.

SUMMARY OF THE INVENTION

The present invention is derived from this VLDC hypothesis, and the object thereof is to provide a foam generator having an increased processing capacity. Said object is attained according to the invention in that for the aforementioned foam generator, which is to be considered known, and within a range for the sectional area of the mixing chamber between 40 and 90 $cm^2$, the vortex-line density coefficient (VLDC) amount to at least 1.5.

The surprising result of a foam generator so dimensioned consists in an appreciably larger processing capacity than could be anticipated from a simple calculation based upon the VLDC hypothesis. Departing from one of the known foam generators (example B in the TABLE hereinafter), it is possible to predict that rendering the number of pins greater than that used so far will double the capacity (example C in the TABLE referred to). The invention provides a quadrupling, as indicated under I in the TABLE. It is to be noted in this connection that, when calculating the VLDC factor, it is always assumed that each rotor pin is, over its entire length, provided with two ribs bringing about a vortex trail during operation.

Preferably, in the case of the foam generator of the invention, the vortex-line density coefficient is between 2.4 and 3.0. As ascertained experimentally, this range is a quarantee for attaining a capacity increase exceeding the value to be anticipated by calculation.

For purposes of assembling and disassembling the foam generator according to the invention, and also considering the high rate of pin occupancy of both rotor and stator, it may be favorable to construct both the rotor body and the stator body from the same number of rings as there are pin rings, each ring with its associated pin ring being fixed consistently in the same relative position with respect to the two adjoining rings. This arrangement also affords adjusting the mixing chamber in the event of the liquid and the foam intended are changed.

BRIEF DESCRIPTION OF THE DRAWING

The invention will now be described with reference to the accompanying drawings, in which an embodiment of the invention is shown for purposes of illustration, and in which.

DESCRIPTION OF PREFERRED EMBODIMENTS

Figure 1:
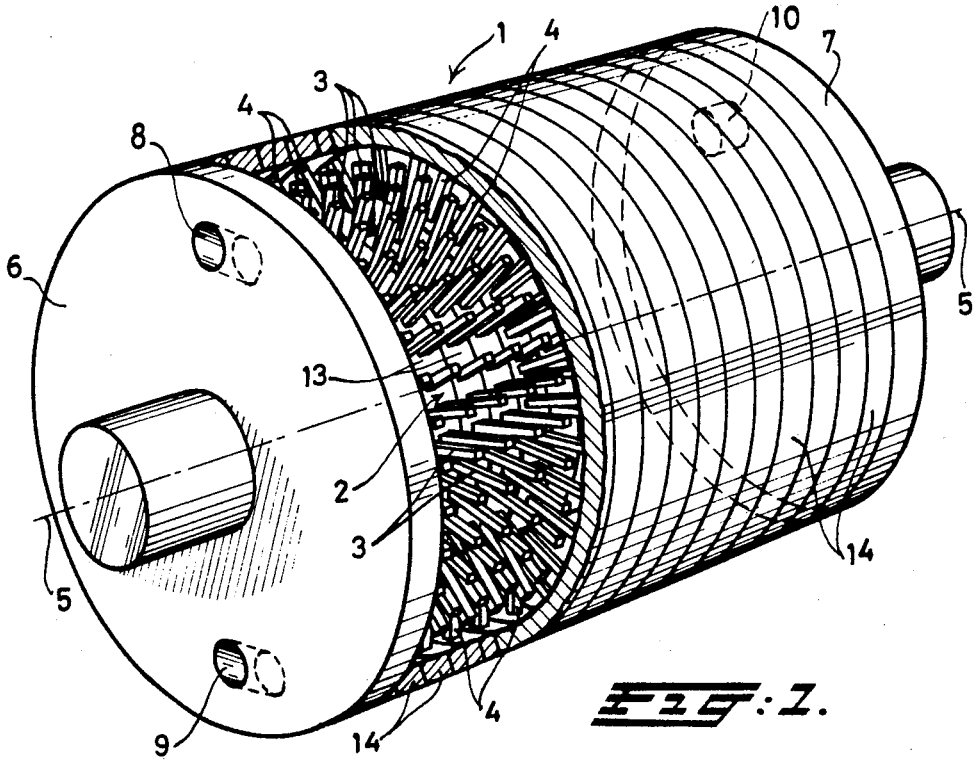
FIG. 1 is a perspective side view of the foam generator according to the invention, with foam generator parts partially cut away.

The foam generator of the invention is, in conventional fashion, composed of a hollow cylindrical stator body 1 having a diameter D and a cylindrical rotor body 2 coaxially rotatably driven therein and having a diameter d. Said bodies 1 and 2 confining a mixing chamber are respectively provided with rings of radial pins 3 and 4 having a constant cross section. Viewed in the direction of the longitudinal axis, the stator and rotor rings are alternately disposed. The mixing chamber has a length l. The stator 1 is closed at its two extremities by covers 6 and 7, respectively. In the cover 6, there are provided an inlet 8 for liquid and an inlet 9 for gas. The cover 7 at the other extremity of the stator 1 is provided with an outlet opening 10 for the emulsion prepared. Up to this point, the foam generator does not distinguish itself from prior art foam mixers.

The particular feature of the foam generator according to the present invention resides in the formation of the rotor pins 3 and the stator pins 4, and in the special effect occurrent therewith of increasing the capacity. The rotor pins 3 in particular are active in preparing the foam, specifically because said pins are substantially responsible for the vortex trail obtained in the liquid present in the mixing chamber. During rotor rotation, each rotor pin 3 will cause a vortex trail to be formed along the entire length of two ribs 11 and which strongly contributes to the preparation of the desired emulsion. The formation of the rotors pins 3 is then such that the vortex-line density coefficient VLDC has a value of at least 1.5, and preferably between 2.4 and 3.0. The concept of VLDC can be regarded as the total length available within the mixing chamber of vortex-forming ribs of the rotor pins per volume of the mixing chamber, i.e., the annular space available between the rotor and stator. Rib length is then calculated in centimeters, and volume in cubic centimeters. The cross-sectional area of the mixing chamber should then be between 40 and 90 $cm^2$.

In concrete terms, the value indicated for VLDC results in rather dense occupancy of the rotor 2 by pins 3 with a corresponding rate of occupancy on the inner side of the stator 1, by fixed pins 4.

When assuming a foam quality of 200 grams/liter to be prepared from a water-base printing paste mixed with air, the specific capacity F of prior art foam mixers, i.e., the quotient between the maximum capacity expressed in liters/min. and volume of the mixer, likewise expressed in liters, turns out to be in the range of approx. 2.5. In the foam generator according to the invention, the value calculated for F exceeds 10, as will be apparent from the TABLE for two constructive embodiments I and II of the foam generator described hereinbelow.

Figure 2:
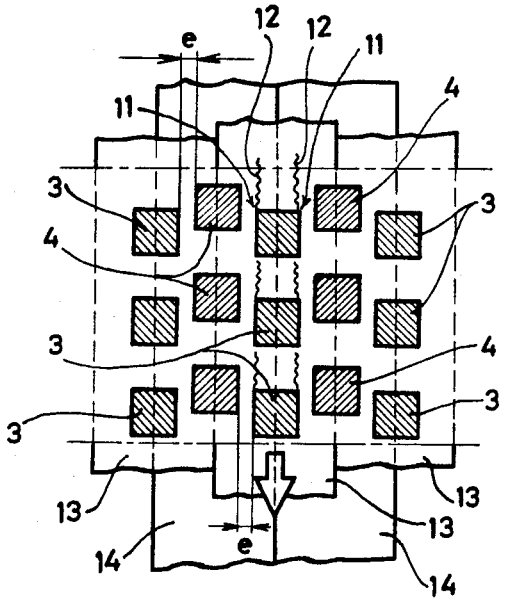
FIG. 2 is a view of the flow pattern within the generator.

It is then also evident that for the foam generator of the invention the number of pins 3 on average provided per $dm.^2$ of rotor surface area amounts to at least 100. The cross section of the rotor pins 3 is in any case tetragonal, (FIG. 2) and the width and thickness of the pins does not exceed 3 mm. At the location of the base of the rotor pins 3, the spacing between two pins juxtaposed in the same ring is equal to the width of one pin, increased by no more than two millimeters. The clearance e between a rotor ring and a stator ring does not exceed 0.75 mm.

The construction of the rotor body 2 and the stator body 1 may be formed from the same number of rings 13 and 14, respectively, as there are pin rings. Each ring with its associated pin ring is then fixed in consistently the same relative position with respect to the two adjoining rings. The latter feature is of importance when removing the rotor body 2, 3, 13 so formed in its entirety from the stator body 1, 4, 14 so formed.

The following table shows values of the dimensions and operating conditions of prior art foam mixers (A and B), of a third, improved mixer (C) derived from B by calculation, and of two embodiments I, II of the foam generator according to the invention, all of this while adding the values calculated for F and VLDC.

TABLE

| Description | Dimension | A | B | C | I | II |
|---|---|---|---|---|---|---|
| cross section pins 3 and 4 | $mm^2$ | 6 × 6 | 5 × 5 | 3 × 3 | 3 × 3 | 3 × 3 |
| clearance e | mm | 1,5 | 1,0 | 0,75 | 0,75 | 0,75 |
| pins 3 and 4 of each rotor and stator respectively | — | 30 | 28 | 42 | 40 | 24 |
| number of rotor rings | — | 9 | 12 | 17 | 17 | 15 |
| number of stator rings | — | 10 | 11 | 18 | 18 | 16 |
| diameter rotor 2 (d) | mm | 144 | 108 | 108 | 100 | 60 |
| diameter stator 1 (D) | mm | 222 | 150 | 150 | 142 | 100 |
| mixing chamber length (l) | mm | 141 | 137 | 137 | 130 | 115 |
| mixing chamber volume (V) | liters | 3,157 | 1,16 | 1,16 | 0,979 | 0,580 |
| speed | RPM | 400 | 525 | 525 | 300 | 570 |
| tangential speed T (radius D/2) | cm/sec | 6,35 | 5,86 | 5,86 | 3,14 | 3,93 |
| $T/T_B$ ratio | — | 1,08 | 1,00 | 1,00 | 0,54 | 0,67 |
| maximum capacity c | 1/min | 8 | 3 | 6,39 | 11 | 6 |
| specific capacity F = c/V | 1/min | 2,53 | 2,59 | 5,51 | 11,24 | 10,34 |
| total length S of all vortex-formimg ribs 11 | cm | 2106 | 1411 | 2998 | 2856 | 1440 |
| vortex-line density coefficient VLDC = S/V | $1/cm^2$ | 0,670 | 1,216 | 2,58 | 2,917 | 2,483 |
| chamber Q = V/l | $cm^2$ | 223 | 84 | 84 | 75 | 50 |

What is claimed is:

1. A foam generator for producing a liquid/gas emulsion having a specific weight of at least 0.1 and comprising a hollow cylindrical stator and a cylindrical rotor coaxially rotatably driven therein, jointly forming a mixing chamber wherein there are disposed alternately in the direction of the longitudinal axis stator and rotor rings of pins having a constant polygonal cross section, said pins on said rotor ring each having a plurality of ribs, the stator ring of pins being stationary, and the rotor ring of pins being rotatable and each causing a vortex trail to be formed along the length of said ribs, said mixing chamber furthermore being provided at one end with an inlet for the liquid and for the gas, there being provided at the other end an outlet opening for the emulsion prepared, the mixing chamber of the foam generator, lying within a range for its sectional area (Q) between 40 and 90 $cm^2$, said generator having a vortex-line density coefficient (VLDC) being the quotient of the total length available within said mixing chamber of vortex-forming ribs of said rotor pins per volume of said mixing chamber, or:

$$\frac{\text{total vortex line length}}{\text{volume of mixing chamber}},$$

and amounting at least to 1.5.

2. The foam generator of claim 1, wherein said vortex-line density coefficient is between 2.4 and 3.0.

3. The foam generator of claim 2, wherein the cross section of the rotor pins is tetragonal, the width and thickness of the pins not exceeding 3 mm.

4. The foam generator of claim 3, wherein at the location of the base of the rotor pins, the spacing between two pins juxtaposed in the same ring is no more than 2 mm greater than the width of one pin.

5. The foam generator of claim 1, wherein the clearance between a rotor ring and a stator ring does not exceed 0.75 mm.

6. The foam generator of claim 1, wherein both the rotor body and the stator body are composed of the same number of rings as there are pin rings, each ring with its associated pin ring being fixed in consistently the same relative position with respect to the two adjoining rings.

* * * * *